US008824925B2

(12) United States Patent
Sugaya et al.

(10) Patent No.: US 8,824,925 B2
(45) Date of Patent: Sep. 2, 2014

(54) IMAGE HEATING APPARATUS

(75) Inventors: Kenjirou Sugaya, Moriya (JP); Tatsuhito Watanabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 13/316,812

(22) Filed: Dec. 12, 2011

(65) Prior Publication Data

US 2012/0148304 A1 Jun. 14, 2012

(30) Foreign Application Priority Data

Dec. 14, 2010 (JP) ..... 2010-278188

(51) Int. Cl.
*G03G 15/16* (2006.01)
*G03G 15/20* (2006.01)

(52) U.S. Cl.
USPC ..... 399/122; 399/329

(58) Field of Classification Search
USPC ..... 399/122, 329
See application file for complete search history.

(56) References Cited

U.S. PATENT DOCUMENTS

| | | | | |
|---|---|---|---|---|
| 6,049,691 | A * | 4/2000 | Abe et al. | 399/330 |
| 6,704,537 | B2 * | 3/2004 | Takeuchi et al. | 399/328 |
| 6,725,009 | B1 * | 4/2004 | Tatematsu et al. | 399/329 |
| 6,731,901 | B2 | 5/2004 | Nishitani et al. | |
| 7,079,800 | B2 * | 7/2006 | Asakura et al. | 399/328 |
| 8,055,175 | B2 | 11/2011 | Sugaya | |
| 2002/0141796 | A1 | 10/2002 | Nishitani et al. | |
| 2002/0168202 | A1 * | 11/2002 | Izawa et al. | 399/329 |
| 2006/0285893 | A1 * | 12/2006 | Ishii | 399/329 |
| 2010/0086335 | A1 | 4/2010 | Sugaya | |
| 2010/0150621 | A1 | 6/2010 | Sugaya | |
| 2010/0178088 | A1 * | 7/2010 | Koshida et al. | 399/328 |
| 2011/0150546 | A1 * | 6/2011 | Koshida | 399/329 |
| 2012/0148318 | A1 * | 6/2012 | Sugaya et al. | 399/329 |
| 2012/0201558 | A1 * | 8/2012 | Watanabe | 399/69 |

FOREIGN PATENT DOCUMENTS

| | | |
|---|---|---|
| JP | 2000-181258 A | 6/2000 |
| JP | 2002-268414 A | 9/2002 |
| JP | 2010-85910 A | 4/2010 |

* cited by examiner

*Primary Examiner* — David Bolduc
(74) *Attorney, Agent, or Firm* — Fitzpatrick, Cella, Harper & Scinto

(57) ABSTRACT

An image heating apparatus includes a heating unit including a rotatable image heating member; an induction heating unit for externally induction heating the image heating member; a nip forming member press-contacting an outer surface of the image heating member to form a nip therewith; a pressing member for pressing the heating unit to the nip forming member; a press releasing member for releasing a pressure of the pressing member to the heating unit; fastening means for fastening the heating unit and the induction heating unit together; and a force receiving portion, provided on the induction heating unit, for contacting the pressing member to move the heating unit away from the nip forming member when the press releasing member releases the heating unit from the pressure of the pressing member.

15 Claims, 14 Drawing Sheets

IMAGE HEATING APPARATUS

FIELD OF THE INVENTION AND RELATED ART

The present invention relates to an image heating apparatus mountable in an image forming apparatus such as an electrophotographic copying machine, an electrophotographic printer, and the like.

There have been known various fixing apparatuses (fixing devices) mountable in an electrophotographic copying machine, an electrophotographic printer, and the like. One of them has been known as a fixing apparatus of the belt heating type, that is, a fixing apparatus which heats an image with the use of a fixation belt. A fixing apparatus of this type is small in thermal capacity, and also, high in heat transmission efficiency. Thus, it starts up very quickly. Therefore, it has been known as a fixing apparatus of the on-demand type.

One of the fixing devices which use a fixation belt is disclosed in Japanese Laid-open Patent Application 2002-268414. This fixing device has: a heat generating member, for example, a ceramic heater (which hereafter may be referred to simply as heater) solidly attached to its supporting member; and a heat transferring member, for example, a belt formed of heat resistant resin (which hereafter may be referred to simply as fixation belt) which is moved in contact with the heater. It has also an elastic pressure roller, as a pressure applying member, which is kept pressed against the heater, with the presence of the fixation belt between itself and the heater, forming thereby a fixation nip, in which a toner image is thermally fixed, between itself and the fixation belt. As for its operation, while a sheet of recording medium, on which an unfixed toner is present, is conveyed through its fixation nip, that is, the nip between the pressure roller and fixation belt, remaining pinched between the pressure roller and fixation belt, the unfixed toner image is melted by the heat transmitted to the unfixed image from the heater through the fixation belt, and becomes fixed to the sheet as it cools down.

Another fixing device which uses a fixation belt has been proposed in Japanese Laid-open Patent Application 2000-181258. This fixing device is structured so that its fixation belt is heated by electromagnetic induction. More specifically, it has a rotational heating member and a magnetic field generating means. The rotational heating member is provided with an electrically conductive layer, and is heated by electromagnetic induction. That is, it is electromagnetically heated by the electric field generated by the magnetic field generating means positioned outside the loop which the rotational heating member forms. The rotational heating member is a thin belt, being therefore small in thermal capacity. Therefore, this fixing device is advantageous in terms of thermal response.

Generally, a fixing apparatus of the so-called belt heating type is provided with a fixation belt (rotational heating member), a pressure roller (pressure applying rotational member), and a pressure applying auxiliary member. The pressure applying auxiliary member is placed within the loop which the fixation belt forms, and is pressed against the pressure roller, with the presence of the fixation belt between itself and the pressure roller, forming thereby a fixation nip between the pressure roller and fixation roller.

Even a fixing device of the so-called belt heating type, such as the one described above, sometimes suffers from the problem that it is jammed by a sheet or sheets of recording medium. If an attempt is made to remove the jammed sheet or sheets of recording medium from a fixing apparatus of this type while its fixation belt is still kept pressed upon the pressure roller, the sheet removing operation becomes very troublesome and irritating. Further, an attempt to forcefully pull out the jammed sheet is likely to scar and/or seriously damage the fixation belt and/or pressure roller. Thus, if a fixing apparatus of this type becomes jammed, it is necessary to remove the pressure between the fixation belt and pressure roller (hereafter, this operation for removing pressure between fixation belt and pressure roller may be referred to simply as "pressure removal").

Referring to FIG. 16, an example of the conventional method for keeping a preset amount of pressure between the fixation belt and pressure roller of a fixing device of the belt heating type is disclosed in Japanese Laid-open Patent Application 2002-268414. In the case of this method, the fixing device is provided with a pair of pressure application springs 617 and a pair of pressure application levers 619, and the preset amount of pressure is kept between the fixation belt and pressure roller by applying the force generated by the resiliency of the pressure application springs is applied by way of the pressure application levers 619. More specifically, the fixing device is provided with the pair of pressure application plates 619 (pressure application levers), a pair of pressure transmitting members 605, a pair of pressure roller supporting members 631, and a pair of spring retaining members 618. The pressure application plate 619 is placed on the top surface of the pressure catching portion 605*a* of the pressure transmitting member 605. One end of the pressure application plate 619 is fitted in the groove 631B of the pressure roller supporting member 631 so that the pressure application plate 619 can be rotationally moved about the point of contact between the pressure application plate 619 and the pressure roller supporting member 631, whereas the other end of the pressure application plate 619 is placed in contact with the bottom end of the spring retaining member 618.

That is, the pressure application plate 619 is made to function as a pressure applying lever. More specifically, the point of engagement between the pressure application plate 619 and pressure plate engaging groove 631B is made to function as the fulcrum 619*a* of the pressure application plate 631 (pressure applying lever), and the point 619*b* of the pressure application plate 619, which is in contact with the bottom end of the spring retaining member 618, is made to function as the point of pressure input. Further, the point 619*c* of contact between the pressure application plate 619 and the pressure catching portion 605*a* of the pressure transmitting member 615 is made to function as the point of pressure application. That is, the pressure application plate 619 is pressed by the compression spring 617, whereby the pressure catching portion 605 of the pressure transmitting member 605 is pressed. Thus, the heating member 602 is pressed on the pressure roller 606 by a combination of a metallic stay 604 and a heating member holding member 603, which is between the pressure transmitting member 605 and heating member 602. Incidentally, designated by referential codes 601, 603, and 632 in FIG. 16 are a heat resistant belt, a heating member holding member, and a pressure roller bearing, respectively.

When it is necessary to remove pressure from the fixation nip of a fixing apparatus (structured like the one described above) in order to deal with a paper jam, the pressure application lever is to be operated in the direction for preventing the force from the pressure application spring from being applied to the pressure roller. Even with the removal of the pressure (from the spring) from the fixation nip, the fixation nip remains under the pressure resulting from weight of the fixation belt unit itself. However, the weight of the fixation belt unit has virtually no effect upon the operation for removing the jammed paper.

The heat generating member of a fixing apparatus which uses a conventional fixation belt is within the loop which the fixation belt forms. In comparison, a fixing apparatus which uses a fixation belt in which heat is electromagnetically induced has a magnetic field generating means as a heat generating means. The magnetic field generating means is outside the fixation belt loop (on opposite side of fixation belt from pressure roller). It has a coil for generating a magnetic field, and a coil supporting frame. The weight of the magnetic field generating means cannot be ignored in terms of its effect upon the fixation nip. That is, in the case of a fixing apparatus which employs a fixation belt in which heat is generated by electromagnetic induction, removing the pressure from the pressure application coil alone leaves the fixation nip portion of the fixing apparatus under the weigh of the magnetic field generating means (electromagnetic induction heating unit). Thus, even after the removal of the pressure from the pressure application spring, the job for removing a jammed sheet of recording medium is still irritating and time consuming.

SUMMARY OF THE INVENTION

Thus, the primary object of the present invention is to provide an image heating apparatus, which has a mechanism for preventing the weight of the member for heating the rotational heating member by electromagnetic induction, and the weight of the rotational heating member itself, from resting on the fixation nip of the apparatus, after the removal of the pressure from the fixation pressure application spring from the fixation nip, being therefore far superior to an image heating apparatus in accordance with the prior art, which employs a rotational fixing member heatable by electromagnetic induction, in terms of the easiness and efficiency with which a jammed sheet can be removed.

According to an aspect of the present invention, there is provided an image heating apparatus comprising a heating unit including a rotatable image heating member; an induction heating unit for externally induction heating said image heating member; a nip forming member press-contacting an outer surface of said image heating member to form a nip therewith; a pressing member for pressing said heating unit to said nip forming member; a press releasing member for releasing a pressure of said pressing member to said heating unit; fastening means for fastening said heating unit and said induction heating unit together; and a force receiving portion, provided on said induction heating unit, for contacting said pressing member to move said heating unit away from said nip forming member when said press releasing member releases said heating unit from the pressure of said pressing member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described with reference to the appended drawings. If a component, a portion thereof, etc., of the image heating apparatus in one of the preferred embodiments of the present invention, are the same in function to the counterparts of the image forming apparatus in another preferred embodiment, they are given the same referential codes, one for one.

Embodiment 1

(Image Forming Apparatus)

Figure 3:
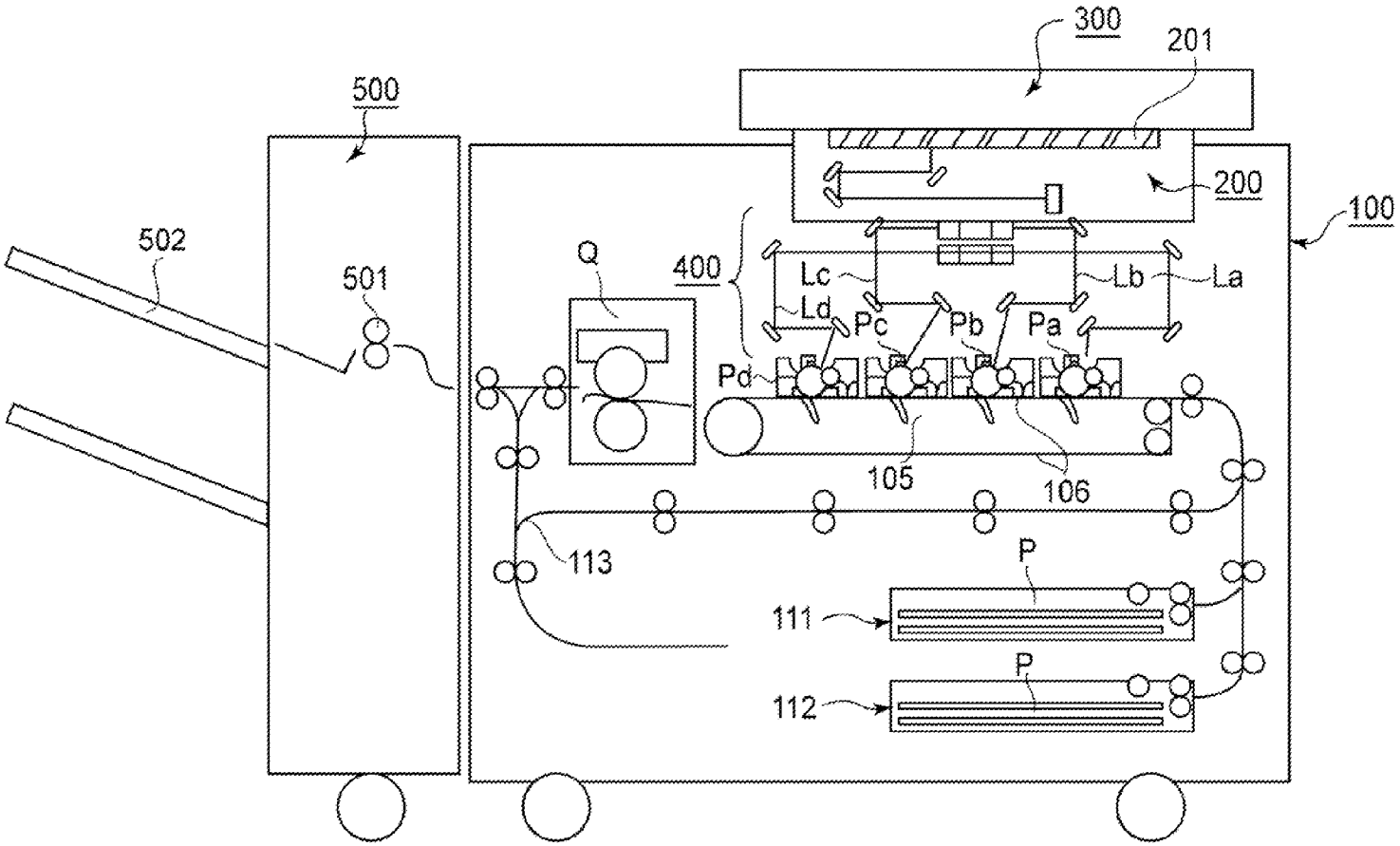
FIG. 3 is a schematic sectional view of an image forming apparatus in which a fixing apparatus in accordance with the present invention is mountable, at a plane parallel to the recording medium conveyance direction.

FIG. 3 is a schematic sectional view of the image forming apparatus in the first preferred embodiment of the present invention, which employs an image heating apparatus in accordance with the present invention, as its fixing device, at a plane parallel to the recording medium conveyance direction of the apparatus. More concretely, the image forming apparatus in this embodiment is a color printer, which uses an electrophotographic process. It has multiple (four) optical scanning means and multiple (four) photosensitive drums. The four drums are aligned in tandem and are in parallel to each other. It has also an image reader 200 which obtains from a full-color original image, the information necessary to form a copy of the original. That is, it separates an original full-color image into four monochromatic images which are different in color, with the use of its photo-electric conversion element, such as a CCD. The image reader is on top of the main assembly of the image forming apparatus. Designated by a referential code 300 is an apparatus for automatically feeding an original onto the original holding glass platen of the original reader 200, or a plate for pressing an original against the original holding glass platen. Designated by a referential code 400 is a scanner having multiple optical scanning means which project beams La, Lb, Lc, and Ld of laser light while modulating the beams with the image information, which is in the form of electrical signals, and obtained through the original reader 200.

Designated by referential codes Pa, Pb, Pc, and Pd are four image forming stations which form magenta, cyan, yellow, and black monochromatic images, respectively. Each image forming station P has a photosensitive drum (which hereafter may be referred to simply as drum), which is rotatable in the clockwise direction. Each image forming station P has also a charging device, a developing device, and a cleaner, which are in the adjacencies of the peripheral surface of the photosensitive drum and are in the listed order. The image forming station P has also a transferring device 105, which is under the four drums. The transferring device 105 has a transfer belt 106 and a transfer charger. The transfer belt 106 is a recording medium conveying means shared by the four image forming stations P. It is an endless belt, and is suspended and kept stretched by three rollers.

The peripheral surface of the drum of each image forming station P is uniformly charged, and then, is scanned (exposed) by a beam La, Lb, Lc, or Ld of laser light projected from the laser scanner 400 while being modulated with the information (in the form of electrical signal) of the original, obtained by the reader 200. As a result, a latent image, which reflects the information of the original (image to be formed) is effected on the uniformly charged peripheral surface of the drum. This latent image is developed by the developing device. Thus, magenta, cyan, yellow, and black toner images are formed in the four image forming stations Pa, Pb, Pc, and Pd, respectively.

Referring to FIG. 3, designated by referential codes 111 and 112 are first and second sheet feeder cassettes, which are inside the main assembly 100 of the printer. One of the sheets P of recording medium (transfer paper, OHP sheet, etc.) in the sheet feeder cassettes 111 or 112 is moved out of the cassette, while being separated from the rest in the cassette. Then, the sheet P is supported by the transfer belt 106, and is conveyed by the belt 106 so that it is moved sequentially through the image forming stations Pa, Pb, Pc, and Pd. As the sheet P is conveyed through the image forming stations Pa, Pb, Pc, and Pd, magenta, cyan, yellow, and black images formed on the four drums, one for one, are sequentially transferred in layers onto the transfer belt 106.

After the completion of the transfer of the four monochromatic toner images, different in color, onto the sheet P on the transfer belt 106, the sheet P is separated from the transfer belt 106, and is conveyed to the fixing device Q of the printer. The toner image on the sheet P of recording medium is fixed to the sheet P by the heat and pressure in the fixing device Q. Then, the sheet P is conveyed, as a full-color print, to a print processing apparatus 500, which discharges the sheet P onto its delivery tray 502 with the use of its pair of sheet conveyance rollers. The print processing apparatus 500 is structured to allow its delivery tray 502 to downwardly move so that a substantial number of prints can be discharged in layers onto the delivery tray 502. Further, the apparatus 500 is enabled to staple a bundle of prints.

When the image forming apparatus is in the monochromatic mode, only the image forming station Pd, that is, an image forming station for forming a black image, is activated. When the image forming apparatus is in the two-sided mode, after the formation of an image on one side of a sheet P of recording medium, the sheet P is directed to the mechanism 113 for turning the sheet P over and sending the sheet P back into the main assembly of the image forming apparatus, in order to form an image on the other side (second surface) of the sheet P. Then, the sheet P is turned over by the sheet turning-and-conveying mechanism 113, and then, is delivered to the transfer belt 106 for the second time. As a result, a toner image is transferred onto the other surface of the sheet P. Then, the sheet P is reintroduced into the fixing device Q. Then, a two-sided print is conveyed to the print processing apparatus 500.

(Image Heating Apparatus)

Figure 2:
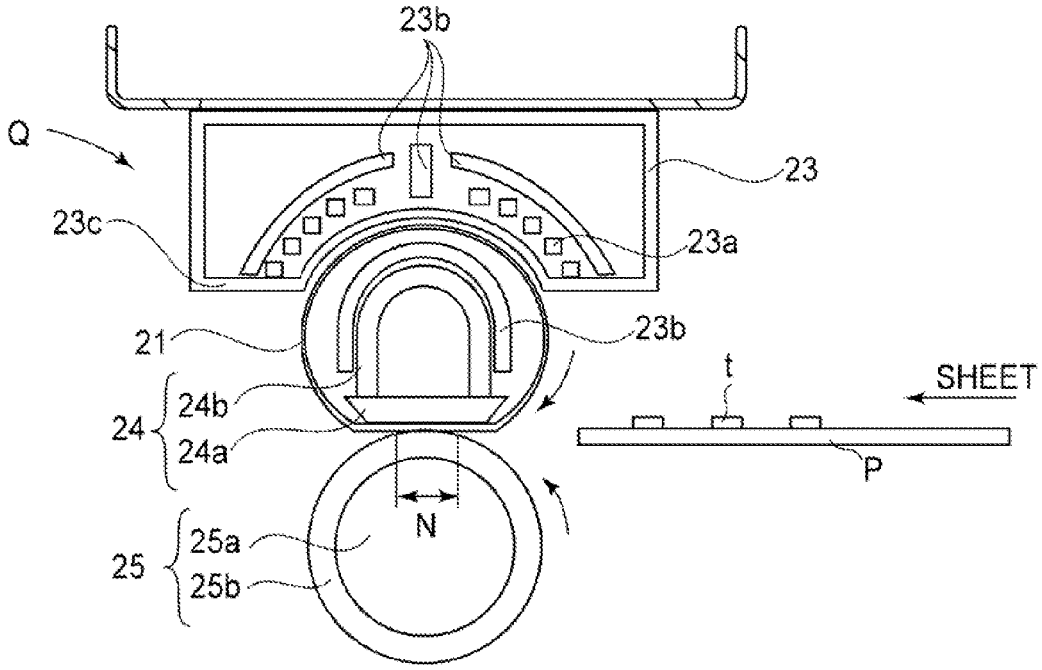
FIG. 2 is a schematic sectional view of the fixing apparatus in accordance with the present invention, shown in FIG. 1, at a plane parallel to the direction in which recording medium is conveyed.

FIG. 2 shows the fixing device Q in this embodiment. The fixing device Q employs a fixation belt which is heated by electromagnetic induction. That is, the image heating member of this fixing device is heated by electromagnetic induction. More specifically, as a magnetic field is generated so that this image heating member, in which heat can be generated by electromagnetic induction, falls within the magnetic field, eddy current is generated in the image heating member. This eddy current generates heat in the image heating member (Joule Effect). The fixing device Q applies this heat generated by the eddy current, to a sheet P of recording medium, that is, an object to be heated. Consequently, the unfixed toner image on the sheet P is thermally fixed to the surface of the sheet P.

Regarding the direction of the fixing device Q, the lengthwise direction is the direction perpendicular to the recording medium conveyance direction, on the surface of the recording medium. The widthwise direction is the direction parallel to the recording medium conveyance direction, on the surface of the recording medium. Further, the length of the fixing device Q is the measurement of the device Q in terms of its lengthwise direction, and the width of the fixing device Q is the measurement of the device Q in terms of the widthwise direction.

Figure 1:
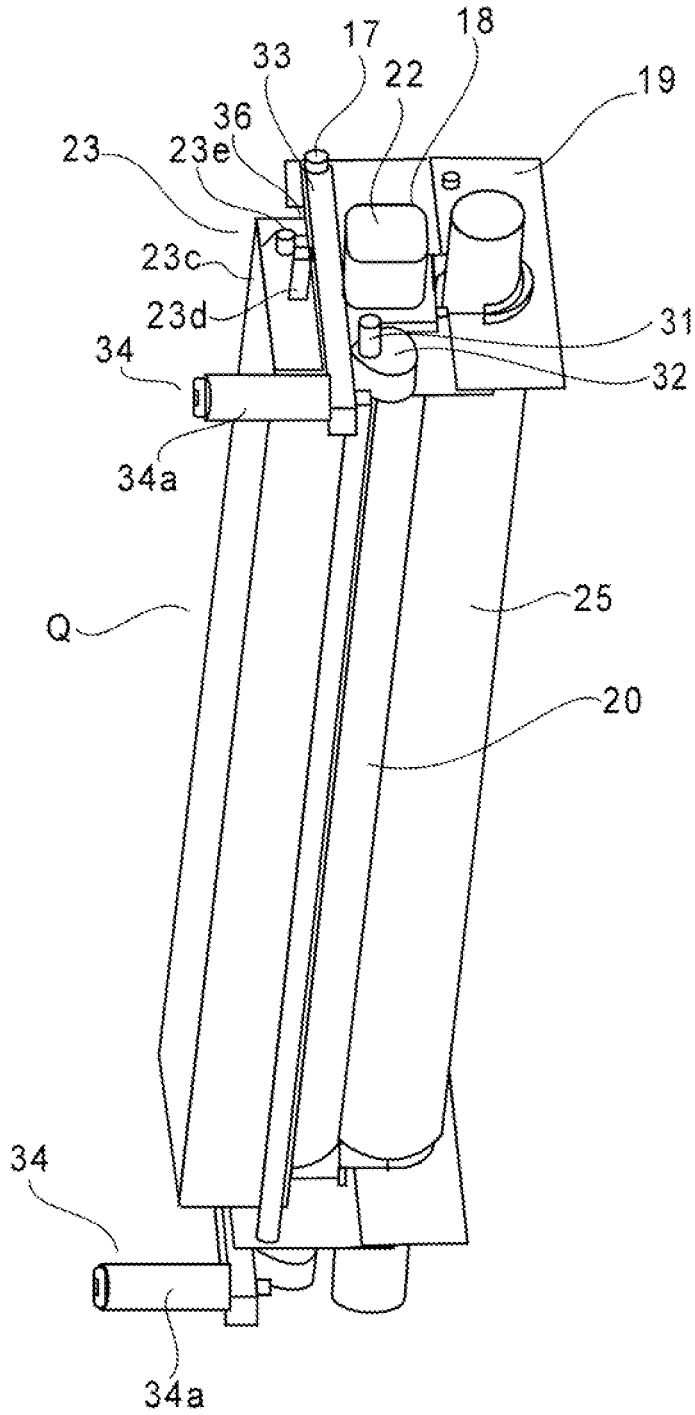
FIG. 1 is a perspective view of a fixing apparatus in accordance with the present invention.
Figure 6:
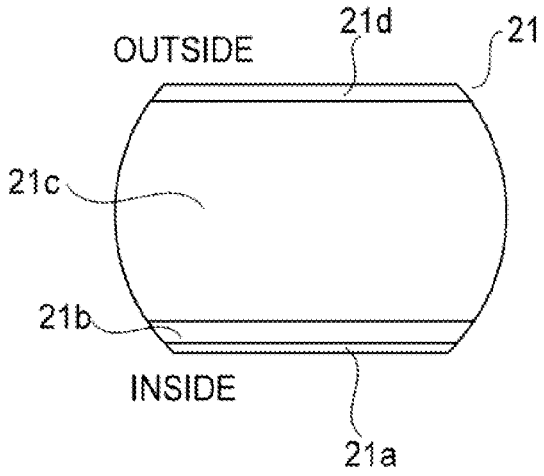
FIG. 6 is a schematic sectional view of a part of the fixation belt in accordance with the present invention, at a plane which is vertical to the surface of the fixation belt and parallel to the recording medium conveyance direction, and shows the structure of the fixation belt.
Figure 7:
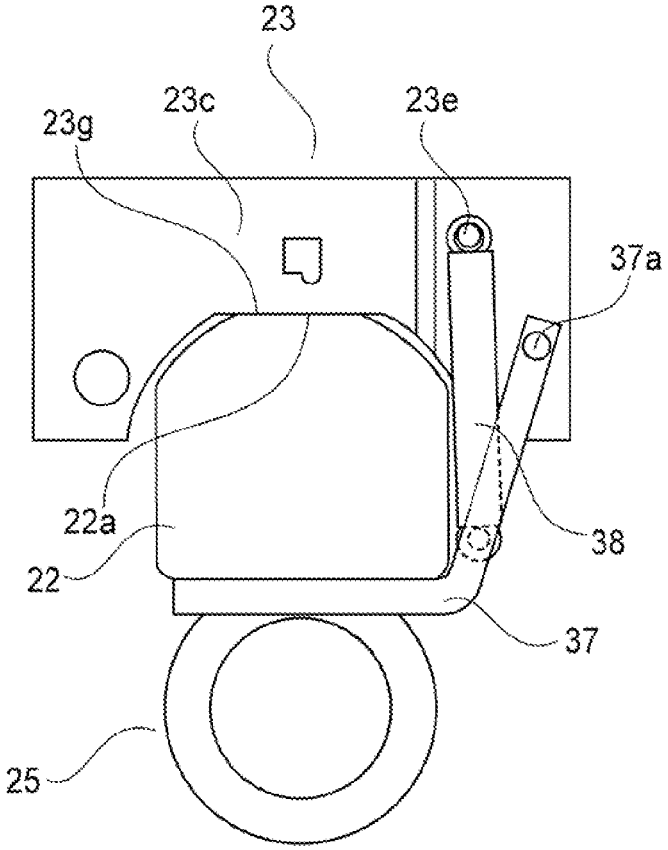
FIG. 7 is a schematic sectional view, at a plane parallel to the recording medium conveyance direction, of the fixing apparatus in the second preferred embodiment of the present invention, which is provided with a toggle for fastening or unfastening the induction heating unit and fixation belt unit relative to each other.

The fixation belt unit 20 in this embodiment has a fixation belt 21, which is cylindrical (endless) and flexible. The fixation belt 21 has an electrically conductive layer 21*b* (FIG. 6). The fixation belt unit 20 has also a pair of flanges 22 (FIG. 1) as a fixation belt holding means. The fixing device Q has also an induction heating unit 23 (magnetic field generating means (FIGS. 1 and 2). The flanges 22 are for holding the fixation belt unit 20. The induction heating unit 23 is a means for heating the image heating member by electromagnetic induction, from the outward side of the loop which the image heating member (fixation belt 21) forms.

Referring to FIG. 2, the fixing device Q has also a pressure applying member 24*a*, a stay 24*b*, and an elastic pressure roller 25. The stay 24*b* is a pressure applying auxiliary member. The elastic pressure roller 25 (which hereafter will be referred to simply as pressure roller), is a pressure applying rotatable member. That is, the fixing device Q is structured so that the fixation belt 21 is heated by electromagnetic induction with the use of the induction heating unit 23, from the outward side of the fixation belt loop. Incidentally, the pressure roller 25 may be replaced with a circularly movable endless belt which is suspended by multiple rollers, or a stationary pressure pad.

(1-1) Induction Heating Unit

Referring to FIG. 2, the fixing device Q is structured so that the induction heating unit 23 is on the outward side of the fixation belt loop, and also, a preset amount of gap is maintained between the induction heating unit 23 and the outward surface of the fixation belt 21, that is, the flexible image heating member which is heated by electromagnetic induction with the use of the induction heating unit 23. The induction heating unit 23 has an excitation coil 23*a* (which hereafter may be referred to simply as coil), a magnetic core (which hereafter may be referred to simply as core), and a holder 23*c* for holding the coil 23*a* and core 23*b*.

The holder 23*c* is roughly in the form of a long rectangle, the lengthwise direction of which is parallel to the lengthwise direction of the fixation belt 21. It is held by the pair of flanges 22 at its lengthwise ends. The bottom surface of the holder 23*c*, that is, the surface which faces the outward surface of the fixation belt 21, is concaved in the form of a semi-cylindrical dome, the curvature of which matches that of the cross section of the fixation belt 21, providing the aforementioned preset amount of gap between the holder 23*c* and the outward surface of the fixation belt 21.

The coil 23*a* is in the form of an oval dome, the lengthwise direction of which is parallel to the lengthwise direction of the fixation belt 21. It is in the hollow of the holder 23*c* in such a manner that there is a preset amount of gap between the outward surface of the fixation belt 21 and the inward surface of the holder 23*c*. The wire of which the coil 23*a* is formed is Litz wire composed of roughly 80-160 fine insulated strands which are 0.1-0.3 mm in diameter and woven together. The coil 23*a* is wound 8-12 times in a manner to follow the contour of the inward surface of the core 23*b*. It is in connection to the excitation circuit (unshown) so that it can be supplied with AC current from the excitation circuit.

The core 23*b* is made of a highly magnetically permeable substance, and has a portion which fits in the center of the coil 23*a*, and a portion which surrounds the coil 23*a*. It plays a role of efficiently guiding the alternating magnetic flux generated by the coil 23*a*, to the electrically conductive layer 21*b* of the fixation belt 21. That is, it is used to contain the magnetic flux to increase in efficiency the magnetic circuit formed by the coil 23*a* and electrically conductive layer 21*b*.

As for the material for the core 23*b*, a substance such as ferrite which is high in permeability and low in residual magnetic flux density is preferable. Since the alternating magnetic flux generated by the coil 23*b* has to be efficiently given to the electrically conductive layer 21*b* of the fixation belt 21, a core 23*b* formed of a highly magnetic substance is positioned on the inward side of the loop which the fixation belt 21, that is, the opposite side of the fixation belt 21 from the core 23*b*. That is, the core 23*b* is between the stay 24*b* and the inward surface of the fixation belt 21.

(1-2) Pressure Roller (Pressure Applying Rotational Member)

The pressure roller 25, which is a heat resistant rotational member for pressure application, is kept pressed upon the outward surface of the fixation belt 21 (image heating member), forming thereby a nip between itself and the fixation belt 21. It has: a metallic core 25*a* which is in the form of a piece of round rod; and an elastic layer 25*b* which covers virtually the entirety of the peripheral surface of the metallic core 25*a* (FIG. 2). The material of the elastic layer 25*b* is heat resistant rubber such as silicone rubber and fluorinated rubber, or foamed silicone rubber. The pressure roller 25 is on the opposite side of the fixation belt 21 from the induction heating unit 23, and is positioned so that its rotational axis is parallel to the widthwise direction of the fixation belt 21. It is rotatably supported at its lengthwise ends, by the bottom plates 19 of the fixing device frame, with the presence of a pair of bearings between its lengthwise ends and bottom plates 19, one for one.

(1-3) Fixation Belt Unit

The fixation belt unit 20, which is a heating unit, has: the fixation belt 21 which is a circularly movable image heating member; a pressure applying auxiliary member 24; the magnetic core 23*b*; and flanges 22.

(1-3-1) Fixation Belt

The fixation belt 21 is a heat resistant, flexible, and cylindrical (endless) member. It is a multilayer belt, comprising an inward layer 21*a*, an electrically conductive layer 21*b*, an elastic layer 21*c*, and a parting layer 21*d*, listing from the inward side of the belt loop (FIG. 6).

The electrically conductive layer 21*b* is the layer in which heat is generated by electromagnetic induction, that is, by the magnetic field (magnetic flux) generated by the induction heating unit 23. It is a cylindrical and flexible metallic layer (which hereafter may be referred to simply as metallic layer) formed of metallic substance such as iron, cobalt, nickel, copper, and chrome. It is roughly 1-50 μm in thickness. The elastic layer 21*c* is on the outward surface of the electrically conductive layer 21*b*, and is formed of a substance pre-selected as a suitable material for the elastic layer of the fixation belt 21.

The parting layer 21*d*, or the surface layer, directly contacts an unfixed toner image t on the sheet P of recording medium. Thus, the material for the parting layer 21*d* needs to be a substance which is excellent in parting. The substances which may be listed as the material for the parting layer 21*d* are tetrafluoroethylene-perfluoroalkylvinyl ether copolymer (PFA), polytetrafluoroethylene (PTFE), silicon copolymer, or combination of these substances, for example. The parting layer 21*d* is formed of one of these substances, selected for a specific purpose, on the outward surface of the elastic layer 21*c*. It is roughly 1-50 μm in thickness.

The parting layer 21*d* rubs against recording medium. Thus, from the standpoint of its durability related to frictional wear, it is desired not to be too thin. That is, if the parting layer 21*d* is too thin, it reduces the service life of the fixation belt 21. On the other hand, if the parting layer 21*d* is too thick, it adds to the thermal capacity of the fixation belt 21, increasing the fixation belt 21 in the length of warm-up time. Thus, the parting layer 21*d* is desired not to be too thick.

In this embodiment, therefore, the parting layer 21*d* (surface layer) of the fixation belt 21 is formed of tetrafluoroethylene-perfluoroalkylvinylether copolymer (PFA), and its thickness is 30 μm.

(1-3-2) Pressure Applying Auxiliary Member

The pressure applying auxiliary member 24 is heat resistant, and is positioned within the loop which the fixation belt 21 forms (FIG. 2). It has a flat plate 24*a* and a stay 24*b*. The flat plate 24*a* is on the inward side of the belt loop, that is, on the opposite side of the fixation belt 21 from the induction heating unit 23, and is in contact with the inward surface of the fixation belt 21. The stay 24*b* is U-shaped in cross section, and is on the flat plate 24*b*, with its open side facing the flat plate 24*b*. The flat plate 24*a* is parallel to the recording medium conveyance direction. The positional relationship between the stay 24*b* and plate 24*a* is such that a vertical plane which coincides with the widthwise centerline of the flat plate 24*a* coincides with the vertical plane which coincides with the widthwise centerline of the stay 24*b*.

(1-3-3) Flange

The fixation belt unit 20 is provided with a pair of flanges 22 (FIG. 1), which are at the edges of the fixation belt 21, one for one. The flanges 22 are held by the top plates 18 of the fixation device frame. Each flange 22 has a "flange portion", which faces the corresponding edge of the fixation belt 21. It is provided with a groove (unshown), in which one of the lengthwise end portions of the pressure applying auxiliary member 24 is fitted to support the member 24 with the flange 22.

Further, the flange 22 has a belt supporting portion (unshown) which is perpendicular to the fixation belt 21. It has also a pressure bearing portion 22*b* which projects in the opposite direction from the pressure roller 25. The belt supporting portion is loosely fitted in the belt loop at the edge of the fixation belt so that the fixation belt 21 is allowed to rotate about the belt supporting portion of the flange 22. That is, the pair of flanges 22 support the fixation belt 21 from within the belt loop, at the edges of the fixation belt 21, one for one, and guide the cylindrical (endless) fixation belt 21. As for the "flange portion" of the flange 22, as the fixation belt 21 shifts in its widthwise direction, it comes into contact with the "flange portion", being thereby prevented from being shifting further. In other words, the "flange portion" regulates the lateral movement of the fixation belt 21.

The pressure bearing portion 22*b* of the flange 22 is under the pressure from the pressure application lever 33 (FIG. 5), which is described later. The pressure applied to the pressure bearing portion 22*b* by the pressure application lever 33 presses the flat plate 24*a* through the stay 24*b*. Thus, the flat plate 24*a* presses the outward surface of the fixation belt 21 on the peripheral surface of the pressure roller 25. Thus, not only is the fixation belt 21 made to deform in a manner to conform to the surface of the flat plate 24*a*, but also, the elastic layer 25*b* of the pressure roller 25 is made to elastically deform in a manner to conform to the surface of the flat plate 24*a*. Therefore, a nip N (fixation nip) with a preset width is formed between the outward surface of the fixation belt 21 and the peripheral surface of the pressure roller 25.

(2) Means for Fastening Induction Heating Unit to Fixation Belt Unit

Figure 4:
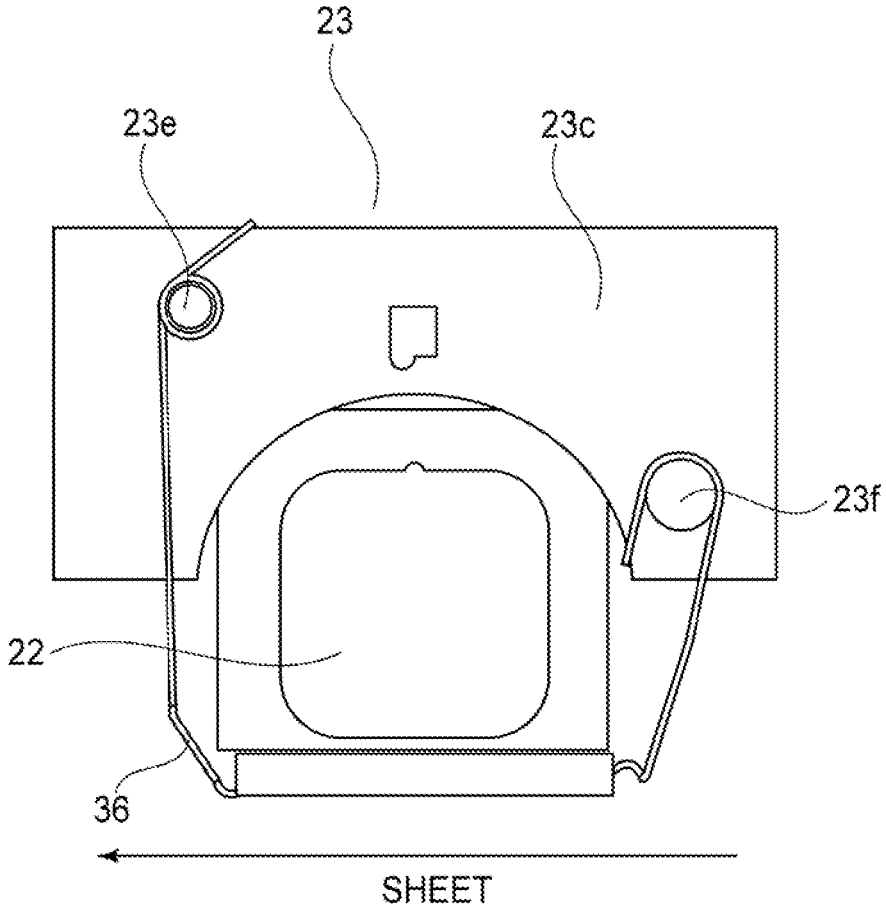
FIG. 4 is a schematic sectional view of a combination of the induction heating unit and fixation belt unit of the fixing apparatus in accordance with the present invention, at a plane parallel to the recording medium conveyance direction, and shows how the induction heating unit and fixation belt unit are fastened to each other.

Next, referring to FIG. 4, the means for fastening the induction heating unit 23 to fixation belt unit 20 is described. In order to keep the fixation belt 21 stable in heat generation efficiency, a preset amount of gap has to be kept between the induction heating unit 23 and fixation belt unit 20.

In this embodiment, therefore, the induction heating unit 23 is provided with a portion 23*e* for holding a pressure applying member. In terms of the recording medium conveyance direction, the pressure applying member holding portion 23*e* is on the downstream side of the induction heating unit 23 (outlet side of fixing device). In terms of the lengthwise direction of the fixing device Q, the pressure applying member holding portion 23*e* is at each of the lengthwise ends of the induction heating unit 23. It is to this pressure generating member holding portion 23*e* (which hereafter will be referred to simply as spring holding portion 23*e*) that one end of a wire spring 36, as a pressure generating member, is attached. The wire spring 36 is extended downward from the spring holding portion 23*e*, bent upstream at the bottom of the flange 22, extended further along the bottom of the flange 22, and bent diagonally upward, away from the flange 22, at the upstream end of the bottom of the flange 22. The other end of the wire spring 36 is hooked around a spring holding portion 23*f* of the induction heating unit 23, which is at each of the lengthwise ends of the induction heating unit 23. In terms of the recording medium conveyance direction, the spring holding portion 23*f* is on the upstream side of the induction heating unit 23.

That is, the means for keeping the units 20 and 23 fastened relative to each other is the wire spring 36, which is attached to the induction heating unit 23 so that one end of the wiring spring 36 is anchored to the downstream end (first position) of the induction heating unit 23; the other end is anchored to the upstream end of the induction heating unit 23; and the center portion of the wire spring 36 wraps around the flange 22. It is by this wire spring 36 that the preset amount of gap is kept between the induction heating unit 23 and fixation belt unit 20 to make it unlikely for the fixation nip N from fluctuating in temperature.

(3) Operation of Induction Heating Unit and Fixation Belt Unit during Fixing Operation, and Removal of Jammed Recording Medium (Thermal Fixing Operation of Fixing Device)

Next, referring to FIG. 2, the thermal fixing operation of the fixing device Q is described. The fixing device Q in this embodiment has: a motor (unshown) as a mechanical power source; and a driver gear (unshown) which is attached to one of the lengthwise ends of the pressure roller 25. The fixing device Q rotates the driver gear in a preset direction by rotating its motor, in response to a print start signal. Thus, the pressure roller 25 rotates in the direction indicated by an arrow mark at a preset peripheral velocity. The rotation of the pressure roller 25 is transmitted to the surface of the fixation belt 21 by the friction between the peripheral surface of the pressure roller 25 and the surface of the fixation belt 21, in the nip N.

Thus, the fixation belt 21 is rotated by the rotation of the pressure roller 25, with its inward surface sliding on the flat plate 24*a* of the pressure applying auxiliary member 24. The surface of the flat plate 24*a*, which is facing the fixation belt 21, and the inward surface of the fixation belt 21, are coated with lubricant such as grease to reduce the friction between the two surfaces.

The excitation circuit begins to supply the coil 23*a* of the induction heating unit 23 with AC current, in response to the print start signal. Thus, the coil 23*a* begins to generate alternating magnetic flux, which is guided to the fixation belt 21 by the core 23*b*, inducing eddy current in the fixation belt 21. This eddy current generates heat in the fixation belt 21 by an amount related to the specific resistance of the electrically conductive layer 21*b* of the fixation belt 21 (Joule Effect).

That is, as the coil 23*a* is supplied with AC current, heat is generated in the fixation belt 21 by electromagnetic induction. The temperature of the fixation belt 21 is detected by a temperature detecting means (unshown) such as a thermistor, and the output signals (electrical signals which represent fixation belt temperature) of the thermistor are picked up by an electric power control circuit (unshown), which turns on or off (controls) excitation circuit so that the temperature of the fixation belt 21 remains at a preset level (target temperature).

As soon as the pressure roller 25 and fixation belt 21 begin to rotate at a preset speed, and the temperature of the fixation belt 21 begins to be maintained at a preset level (fixation temperature), a sheet P of recording medium on which an unfixed toner image t is present, is introduced into the nip N, and conveyed through the nip N, remaining pinched between the outward surface of the fixation belt 21 and the peripheral surface of the pressure roller 25. While the sheet P is conveyed through the nip N as described above, the unfixed toner image t on the sheet P is subjected to the heat from the fixation belt 21 and the internal pressure of the nip N. Thus, the unfixed toner image t becomes fixed to the surface of the sheet P. As the sheet P is conveyed out of the nip N, it is separated from the surface of the fixation belt 21.

(Pressure Application for Fixation, and Operation for Removing Fixation Pressure to Deal with Paper Jam)

FIG. 1 is a perspective view of the fixing device in this embodiment. The fixing device in this embodiment has a mechanism for moving the fixation belt unit 20 relative to the pressure roller 25 (pressing fixation belt unit against pressure roller 25, or separating fixing belt unit from pressure roller 25). The pressuring applying/removing mechanism has: a cam shaft 31, which is a rotational member; a pair of pressure application levers 33; and a pair of vises 34 with a spring, as a pressure generating means. The cam shaft 31 is rotatably supported by a pair of upper lateral plates 18 which are at the lengthwise ends of the fixing device frame. The cam shaft 31 has a pair of eccentric cams 32, which are at the lengthwise ends of the cam shaft 31. The eccentric cams 32 are members for freeing the induction heating unit from the pressure applied to the heat unit by the pressing generating member. The cam shaft 31 has also an unshown pressure removal gear, which is attached to one of the lengthwise end of the cam shaft 31.

The motor of the fixing device is rotated in response to a signal for initiating an operation for dealing with paper jam. As the motor is rotated, the unshown pressure removal gear is rotated in a preset direction by a preset amount by an unshown driving force transmitting gear. As the pressure removal gear is rotated, the camshaft 31 rotates, and therefore, the eccentric cams 32 rotate.

The pressure application levers 33 are rotatably supported at one of its lengthwise ends, by a shaft 17, which is supported by the aforementioned top lateral plates 18. The other end of the pressure application lever 33 is kept pressured toward the flange 22 by the compression springs 34*a* with which the vises 34 are fitted. That is, the pressure application lever 33 is rotatable about the shaft 17 (fulcrum D) in the direction to directly press the pressure catching portion 22*b* of the flange 22, or in the direction to move away from the pressure catching portion 22*b* of the flange 22.

Figure 5:
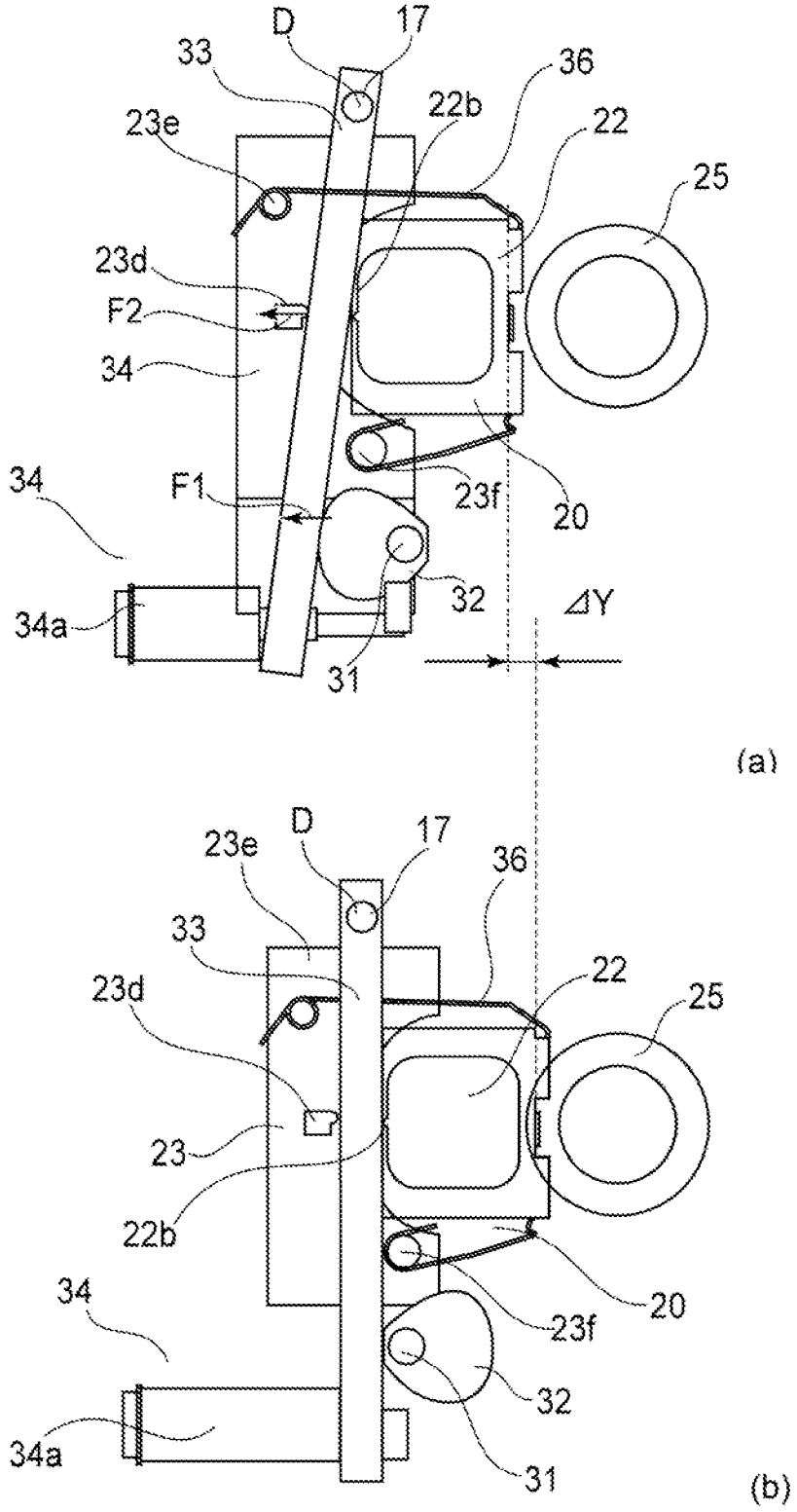
In FIGS. 5, (*a*) and (*b*) are schematic sectional views of the fixing apparatus in accordance with the present invention, at a plane parallel to the recording medium conveyance direction, and show the states of fixing apparatus when the fixation nip of the apparatus is under and free from, respectively, the pressure from the fixation pressure applying means.

FIG. 5 is a drawing for describing the state of the fixing device when the flange 22 (induction heating unit) is under the pressure from the compression spring 34*a*, and that when the flange 22 is not. As the camshaft 31 is rotated, the eccentric cam 32 rotates the pressure application lever 33 about the fulcrum D against the pressure from the compression spring 34*a* of the vise 34, in the direction to separate from the flange 22. That is, a force F2 is applied to the pressure application lever 33 by the eccentric cam 32. As the amount by which the pressure application lever 33 is being rotated reaches at preset value, the pressure application lever 33 (pressure applying member) comes into contact with a projection 23*d* (pressure catching portion) of the induction heating unit 23.

As the pressure application lever 33 comes into contact with the projection 23*d* of the induction heating unit 23, the pressure application lever 33 catches the combination of the weight of the fixation belt unit 20 and the weight of the induction heating unit 23, reducing thereby the nip pressure. That is, a force F2 is applied to the induction heating unit 23 by the pressure application lever 33. Thus, the weight of the induction heating unit 23 is supported by the pressure application lever 33. Further, the preset amount of gap is maintained between the fixation belt unit 20 and induction heating unit 23 by the wire spring 36 (resilient member). Therefore, the weight of the fixation belt unit 20 also is supported by the pressure application lever 33. Thus, the fixation belt unit 20 and pressure roller 25 are kept separated by a gap of ΔY. That is, the combination of the weight of the induction heating unit 23 and the weight of the fixation belt unit 20 is kept away from the fixation nip N.

That is, as the pressure applied to the induction heating unit 23 by the combination of the pressure application lever 33 and the pressure generating member is removed by the pressure removing member, the pressure applying member (pressure application lever 33) comes into contact with the pressure catching portion 23*d* of the induction heating unit 23, causing thereby the pressure catching portion 23*d* to catch the force (pressure) for removing the pressure applied to the nip forming member by the combination of the weight of the induction heating unit 23 and that of the fixation belt unit 20 of the induction heating unit 23.

Embodiment 2

FIGS. 7-11 are for describing the fixing device in the second preferred embodiment. The fixing device in this embodiment employs a toggle as a means for keeping the induction heating unit 23 and fixation belt unit 20 fastened to each other.

(Structure of Toggle)

A toggle is a mechanism made up of a pair of jointed arms (links) and a slider. The force to be inputted into the mechanism is transmitted through a linkage. As the force is inputted, the pair of jointed arms moved toward the direction from which the force is inputted, until the jointed arms lock themselves with the objects, such as a wall, around them. Once the jointed arms lock themselves with the surrounding objects, they do not move backward, anchoring the mechanism against the external force which is opposite in direction from the input force.

The toggle in this embodiment has a lever 37 and a spring 38. The lever 37 corresponds to the pressure application lever 33 in the first embodiment. The toggle is at each of the lengthwise ends of the induction heating unit 23. Each lever 37 holds the corresponding flange 22 which is at the lengthwise end of the fixation belt unit 20. The spring 38 keeps a preset distance between the fixation belt unit 20 and induction heating unit 23.

In this embodiment, the means for keeping the induction heating unit 23 and fixation belt unit 20 fastened to each other includes a pressure generating means. The means is enabled to take two positions, that is, the first and second positions. When the fastening means is in the first position, it keeps the fixation belt unit 20 and induction heating unit 23 fastened to each other, whereas when it is in the second position, it keeps the fixation belt unit 20 separated from the induction heating unit 23.

Figure 8:
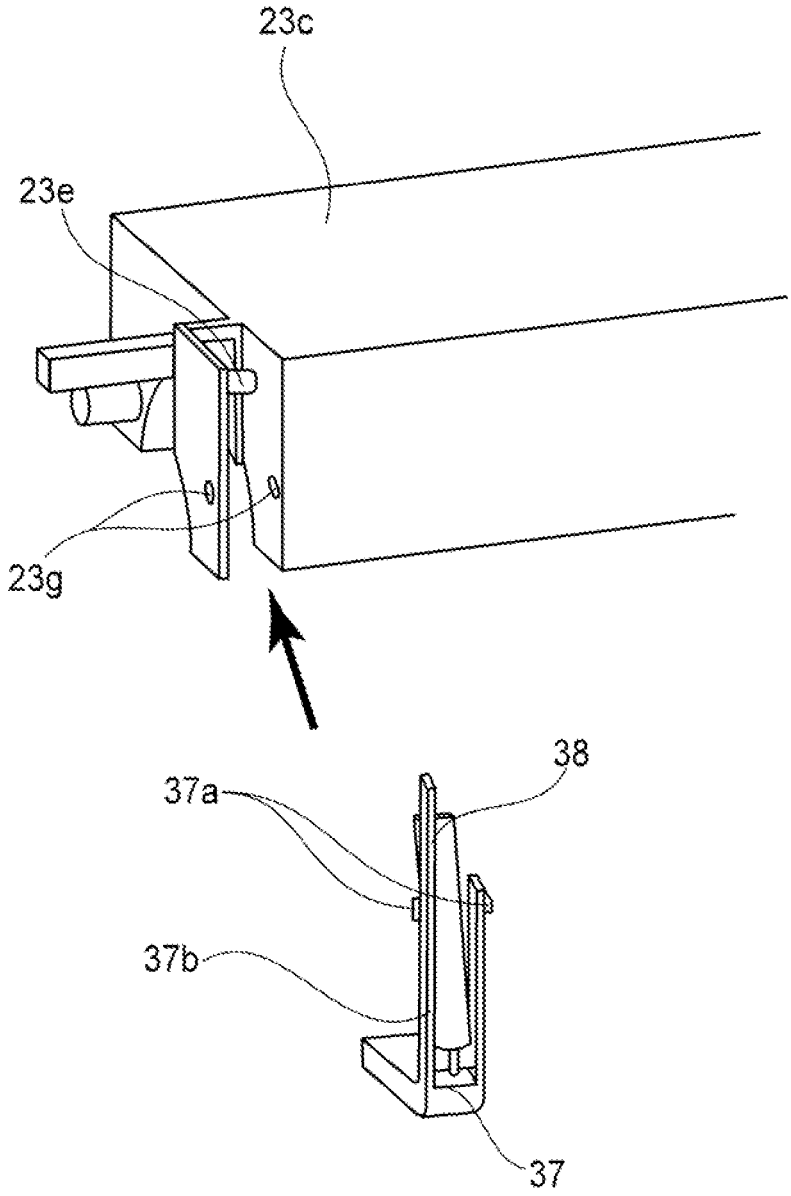
FIG. 8 is an exploded perspective view of one of the lengthwise ends of the induction heating unit, and shows how the toggle, shown in FIG. 7, is attached to the toggle holder of the induction heating unit.

Next, the method for attaching the toggle to the induction heating unit 23 is described. Referring to FIG. 8 which is an exploded perspective view of one of the lengthwise ends of the induction heating unit 23, the shafts 37*a* of the lever 37 fit in the hole 23g of the holder 23c, enabling the lever 37 to rotationally move about the axial lines of the shaft 37a. One end of a spring 38 is attached to the spring holding portion 37b of the lever 37, which is between the two arms of the lever 37.

Figure 9:
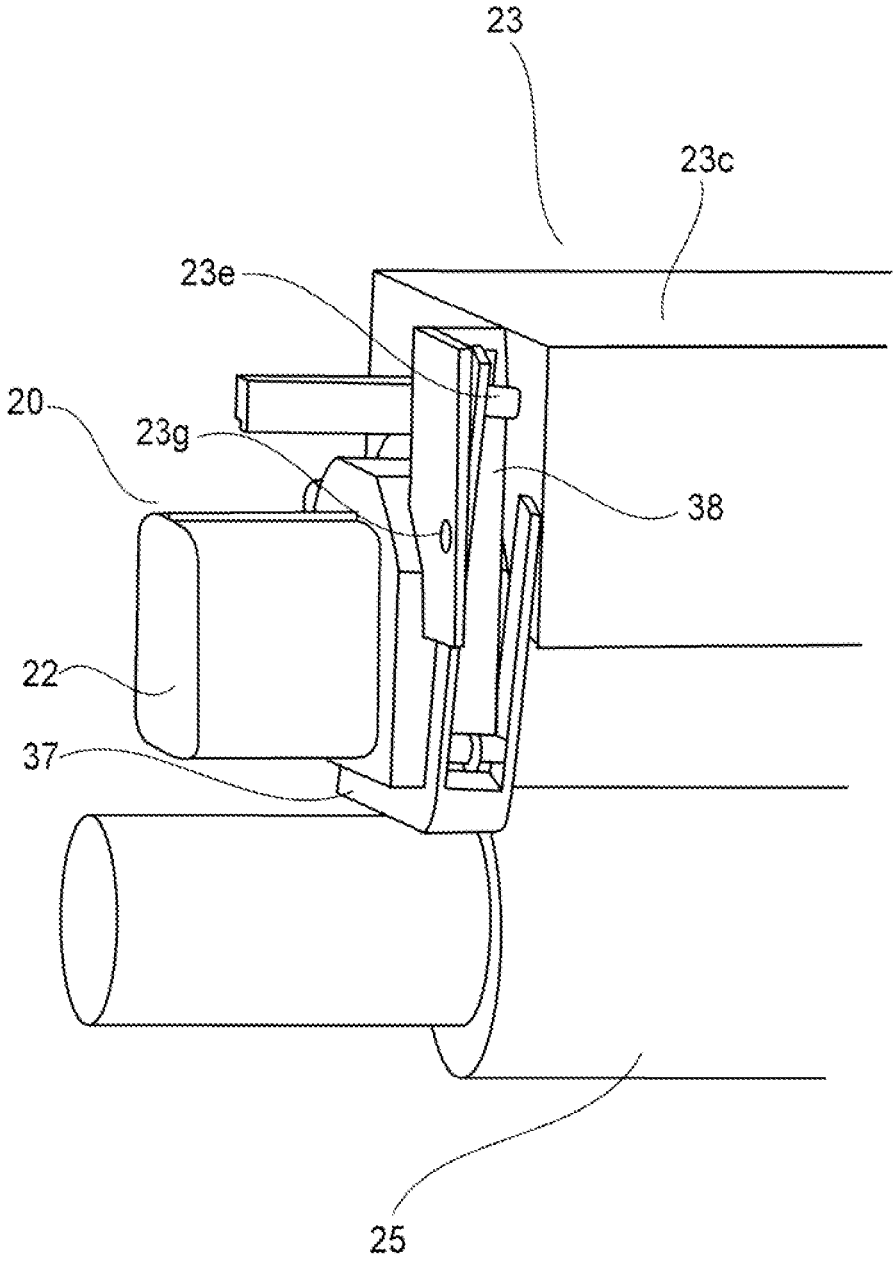
FIG. 9 is a perspective view of one of the lengthwise ends of the fixing device after the attachment of the toggle.
Figure 10:
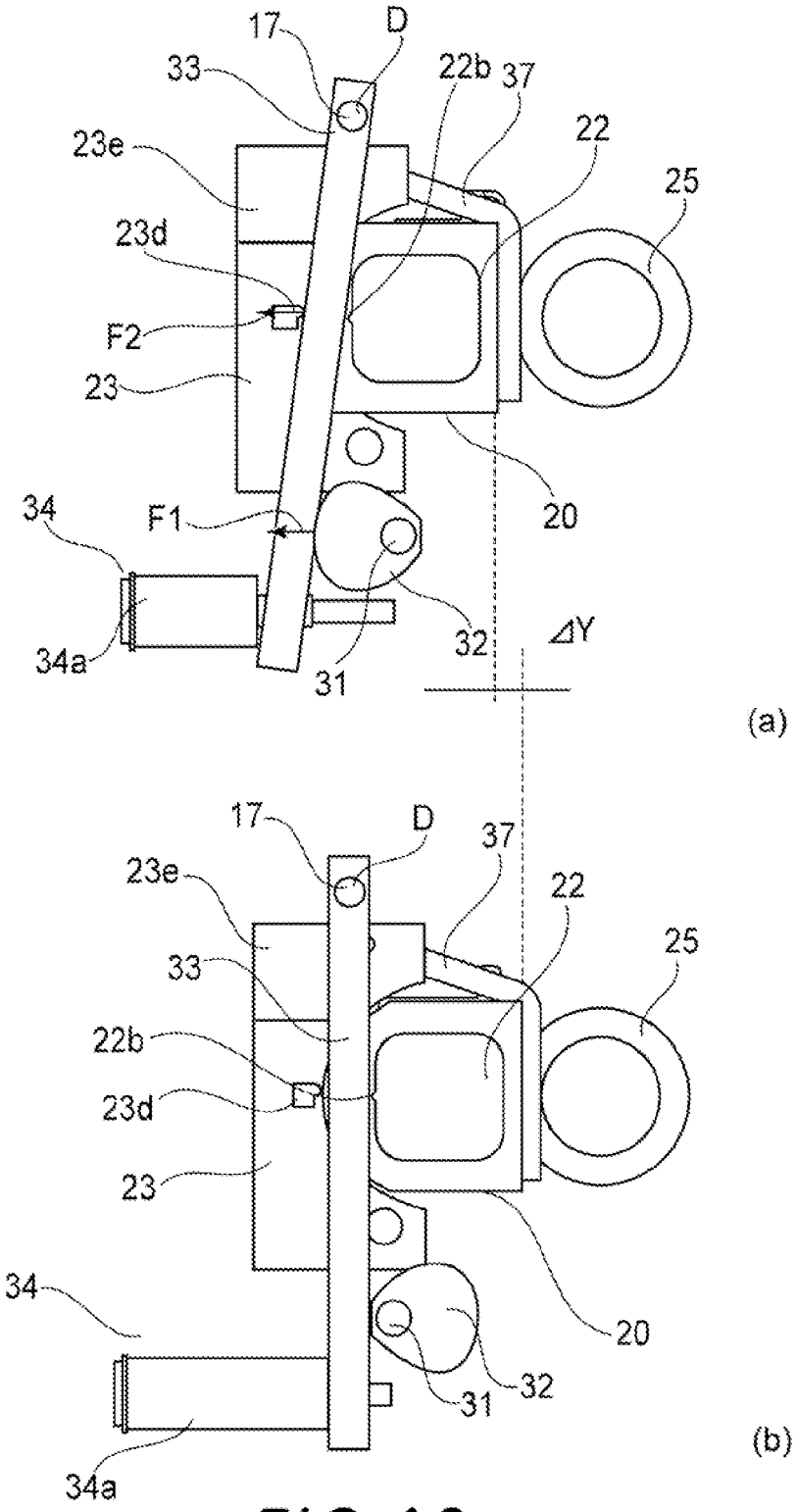
In FIGS. 10, (*a*) and (*b*) are schematic sectional views of the fixing apparatus in accordance with the present invention, which has a toggle, at a plane parallel to the recording medium conveyance direction, when the pressure from the pressure applying means is on, and off, respectively.

Next, the other end of the spring 38 is attached to the spring holding portion of the holder 23c of the induction heating unit 23. The lever 37 is positioned so that its bottom end portion supports the flange 22 by the bottom side of the flange 22 while remaining pressed upward by the resiliency of the spring 38. Thus, when the fixation belt unit 20 is in the normal condition, the lever 37, the surface 22a (FIG. 7) of the fixation belt unit 20 is kept in contact with the surface 23g (FIG. 7) of the induction heating unit 23 by the lever 37, maintaining thereby a preset distance between the fixation belt unit 20 and induction heating unit 23. FIG. 9 is a perspective view of one of the lengthwise ends of the fixing device in this embodiment after the attachment of the toggle.

(Operation for Applying, or Removing, Pressure)

FIG. 10(a) is a schematic plan view of one of the lengthwise ends of the fixing device in this embodiment when the fixation belt unit 20 is kept pressed against the pressure roller 25, and FIG. 10(b) is a schematic plan view of the same lengthwise end of the fixing device in this embodiment as the one shown in FIG. 10(a), after the separation of the fixation belt unit 20 from the pressure roller 25. When the fixation belt unit 20 is kept pressed upon the pressure roller 25, the fixation belt unit 20 is kept fastened to the induction heating unit 23 by the toggle as the fixation belt unit 20 is by the lever 33 in the first embodiment. Further, since the preset amount of gap is maintained between the fixation belt unit 20 and induction heating unit 23 by the toggle. Therefore, the weight of the fixation belt unit 20 is supported by the pressure application lever 33.

Thus, the fixation belt unit 20 is kept separated from the pressure roller 25 by a distance of ΔY, and the combination of the weight of the induction heating unit 23 and the weight of the fixation belt unit 20 is prevented from resting on the peripheral surface of the pressure roller 25. In other words, the fixing device in this embodiment is superior to any fixing device in accordance with the prior art, in terms of the efficiency with which the paper jam or the like problem can be dealt.

(Method for Attaching Toggle)

Figure 11:
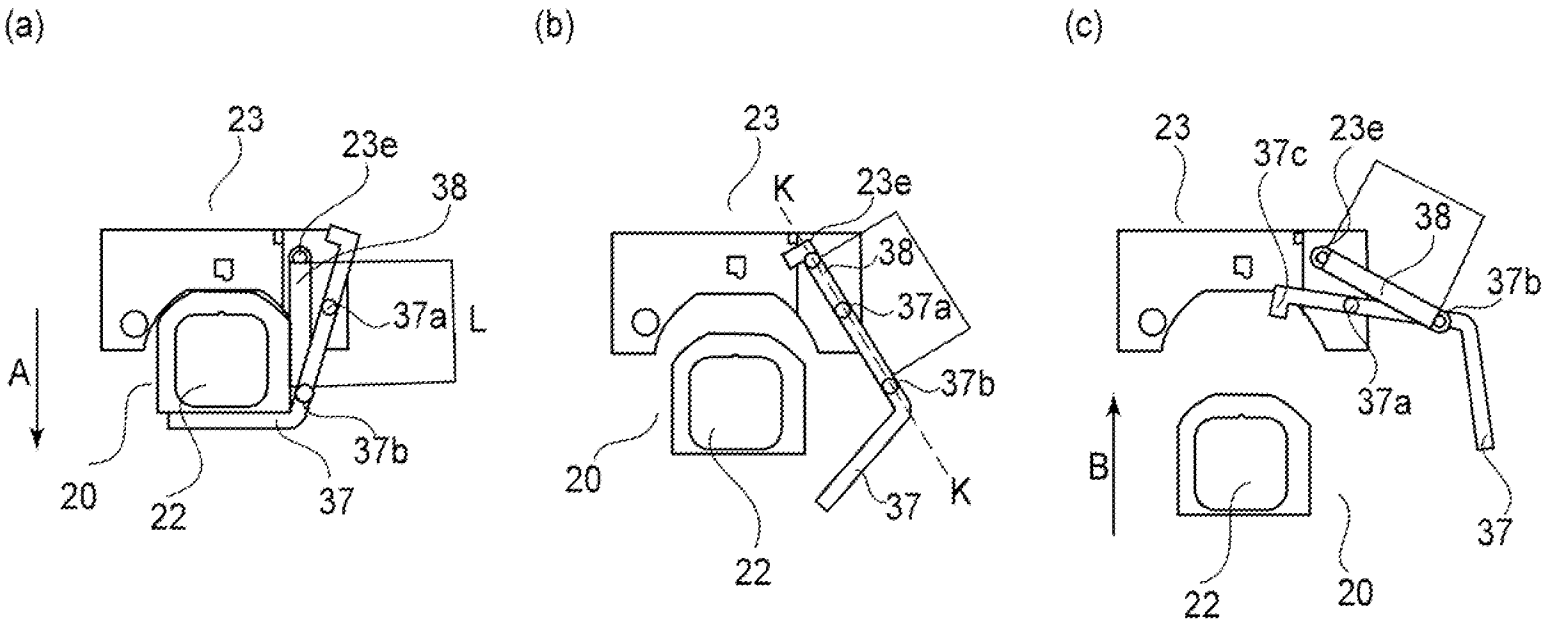
FIG. 11 relates to the rotational movement of the toggle, FIGS. 11(*a*) and 11(*b*) showing the state of the fixing apparatus in accordance with the present invention, when the fixation belt unit is fastened to the induction heating unit, and is being fastened to the induction heating unit, respectively, and FIG. 11(*c*) showing how the fixation belt unit is to be attached to the induction heating unit.

FIG. 11 shows how the fixation belt unit 20 is fastened to induction heating unit 23 by the toggle. FIGS. 11(a), 11(b) and 11(c) shows the fixing device after, during, and before the fastening of the fixation belt unit 20 to induction heating unit 23 by the toggle, respectively.

First, the procedure for unfastening the fixation belt unit 20 from the induction heating unit 23 is described. As described above, one of the lengthwise ends of the spring 38 is attached to the spring holding portion 37b of the lever 37, and the other is attached to the spring holding portion 23 of the induction heating unit 23. The spring 38 is enabled to be rotated about the spring holding portion 23e, and the lever 37 is enabled to be rotated about the shaft 37a.

FIG. 11(a) shows the fixing device in this embodiment when the fixation belt unit 20 and induction heating unit 23 is kept fastened to (in contact with) each other by the combination of the lever 37 and spring 38. When the fixing device is in the state shown in FIG. 11(a), the fixation belt unit 20 is kept pulled toward the induction heating unit 23 by the resiliency of the spring 38.

If it is necessary to separate the fixation belt unit 20 from the induction heating unit 23, the fixation belt unit 20 is to be moved in the direction indicated by an arrow mark A. As the fixation belt unit 20 is moved in the direction of the arrow mark A, the bottom portion of the flange 22 pushes the lever 37, causing thereby the lever 37 to rotate counterclockwise about the shaft 37a. As the lever 37 is rotated counterclockwise, the state of the fixing device changes from the one shown in FIG. 11(a) to the one shown in FIG. 11(b).

Referring to FIG. 11(b), a line K-K' is a hypothetical line between the shaft 37a and spring supporting portion 23e. As the lever 37 is rotated counterclockwise beyond the line K-K', the resiliency of the spring 38 acts to rotate the lever 37 counterclockwise, rotating thereby the lever 37 into the position shown in FIG. 11(c).

Next, the procedure for fastening the fixation belt unit 20 to the induction heating unit 23 is described. When the fixing device is in the state shown in FIG. 11(c), the fixation belt unit 20 is to be moved in the direction indicated by an arrow mark B. As the fixation belt unit 20 is moved in the direction of the arrow mark B, the flange 22 of the fixation belt unit 20 pushes the lever 37, causing thereby the lever 37 to rotate clockwise about the shaft 37a. As the rotation of the lever 37 continues, the position of the lever 37 changes from the one shown in FIG. 11(c) to the one shown in FIG. 11(b). Then, as the lever 37 is rotated enough for its shaft 37b to move beyond the line K-K', the resiliency of the spring 38 acts to cause the lever 37 to rotate clockwise, changing thereby the position of the lever 37 from the one shown in FIG. 11(b) to the one shown in FIG. 11(a). Consequently, the fixation belt unit 20 is held against the induction heating unit 23 by the lever 37.

Embodiment 3

Figure 12:
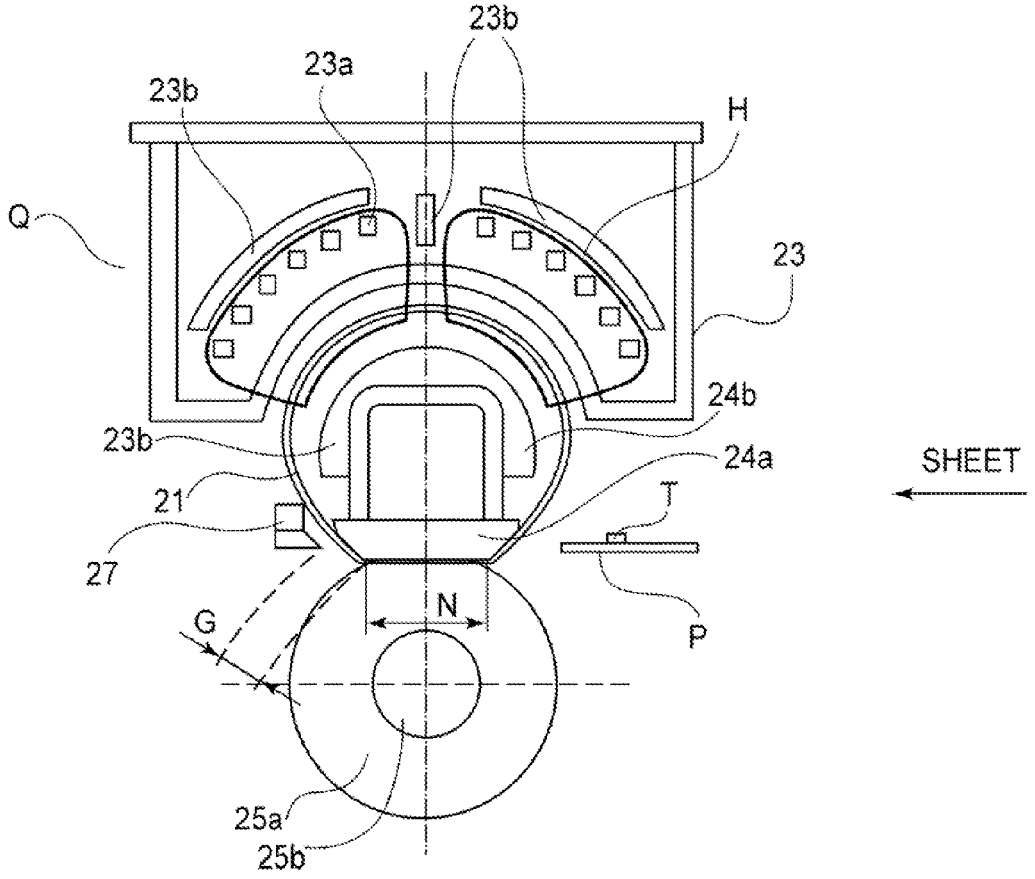
FIG. 12 is a schematic sectional view, at a plane parallel to the recording medium conveyance direction, of the fixing apparatus in the third preferred embodiment of the present invention, which is provided with a separation guide.

FIG. 12 is a schematic sectional view of the fixing device in the third preferred embodiment of the present invention, at a plane parallel to the recording medium conveyance direction. This embodiment is different from the first embodiment in that the fixing device in this embodiment has a recording medium guide 27 for separating a sheet P of recording medium from the fixation belt 21. Hereafter, this guide 27 is referred to as a separation guide 27. Otherwise, this embodiment is the same as the first embodiment. That is, the fixation belt unit and induction heating of the fixing device themselves in this embodiment are the same in structure as the counterparts in the first embodiment, and the fixing operation of the fixing device in this embodiment is the same as that in the first embodiment. Therefore, they are not going to be described here.

(Separation Guide)

The fixing device in this embodiment is provided with at least one separation guide 27 for separating a sheet of recording medium (paper) from the fixation belt 21. The separation guide 27 is not in contact with the fixation belt 21, and is on the fixation belt side relative to the hypothetical extension of the fixation nip N. When a toner image on a sheet of recording paper is thermally fixed, the fixation belt 21 is on the toner image side of the sheet. Thus, the sheet tends to stay adhered to the fixation belt 21 after the fixation of the toner image. This is why the separation guide 27 is positioned on the fixation belt side.

The separation guide 27 is positioned close to the fixation belt 21. More specifically, it is positioned so that a gap G (1 mm, for example) is maintained between the surface of the fixation belt 21 and the sheet separating edge of the separation guide 27. Next, the method for fastening the separation guide 27 to flange 22 so that the gap G is maintained is described.

The fixation belt 21 in this embodiment also is supported by the pair of flanges 22 which are at the edges of the fixation belt 21 as in the first embodiment described above. That is, the fixation belt 21 in this embodiment also is kept properly positioned by the flanges 22 in terms of its widthwise direction. In other words, the flanges 22 function as guiding members which hold the fixation belt 21 (as image heating belt) at the edges (widthwise ends) of the fixation belt 21.

Figure 13:
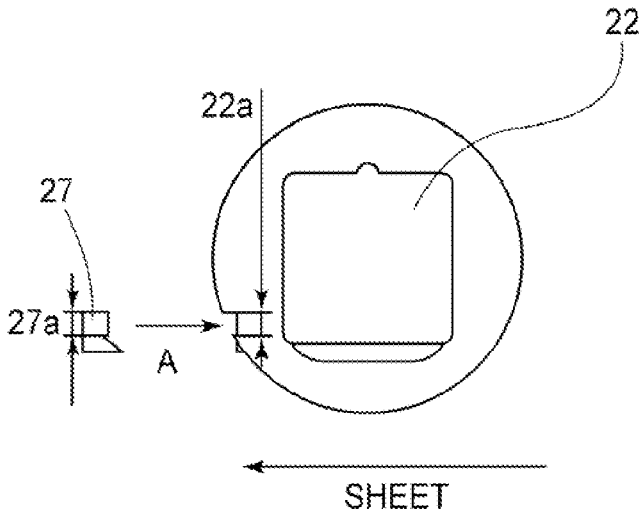
FIG. 13 is a drawing for showing how the separation guide is to be attached to the flange of the fixing device in the third embodiment.
Figure 14:
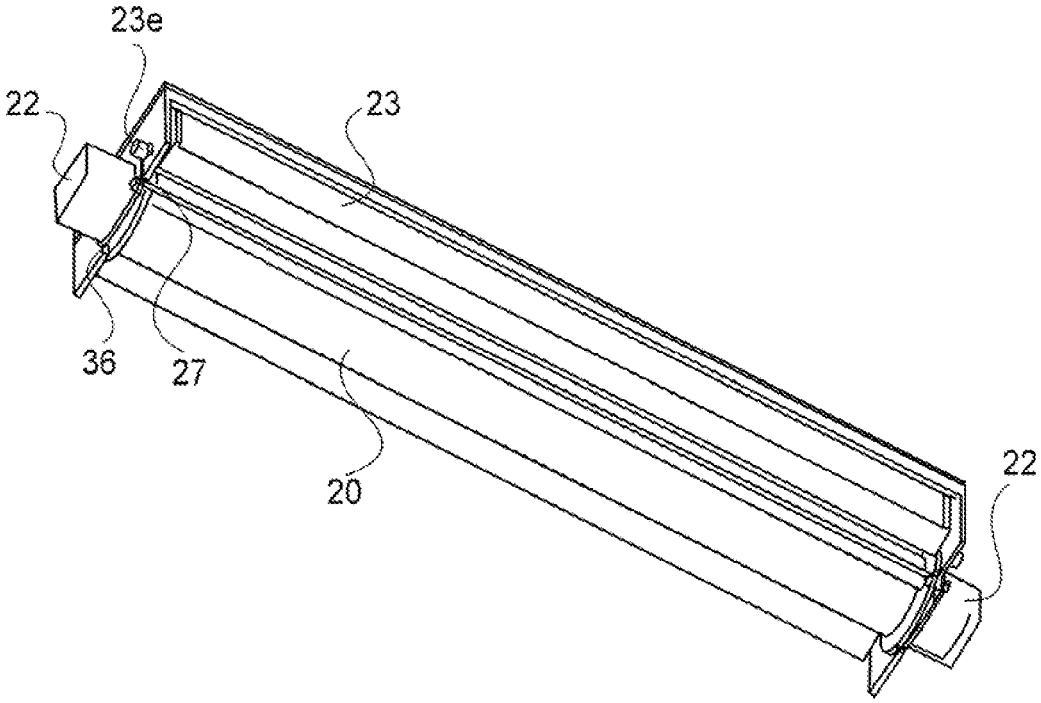
FIG. 14 is a perspective view of the fixing device in the third embodiment, which has the separation guide.

As a means for controlling the gap G between the outward surface of the fixation belt 21 and the sheet separating edge of the separation guide 27, it is effective to attach the separation guide 27 to the flanges 22. In this embodiment, therefore, the separation guide 27 is provided with a pair of projections, which are at the lengthwise ends of the separation guide 17, whereas each flange 22 is provided with a groove 22*a*. Thus, the separation guide 27 is attached to the flanges 22 by inserting each of the projections 27*a* of the separation guide 27 into the corresponding groove 22*a* in the direction indicated by an arrow mark A, as shown in FIG. 13. The separation guide 27 has to be kept properly positioned. Therefore, it has to be kept pressed against the flange 22 in the direction of the arrow mark A. As the means for keeping the separation guide 27 pressed in the direction of the arrow mark A, the wire spring 36, that is, the means for keeping the preset amount of gap between the induction heating unit 23 and fixation belt unit 20 is utilized as shown in FIG. 14 which is a schematic perspective view of the fixing device in this embodiment. Since the wire spring 36 is resilient, it keeps the separation guide 27 pressed against the flanges 22 in the direction of the arrow mark A so that the separation guide 27 remains fastened to the flanges 22.

As is evident from the description of this embodiment given above, the fixing device in this embodiment can reliably control the gap G (FIG. 12) between the outward surface of the fixation belt 21 and the sheet separating edge of the separation guide 27, even though is very simple in structure in that the projections of the separation guide for separating a sheet of recording medium from the heating belt (fixation belt) are inserted into the groove of the corresponding fixation belt guiding member, and the separation guide is kept pressed against the fixation belt guiding members by the pair of springs.

(Reason for Replacing Fixation Belt Unit)

Referring to FIG. 2, as the fixation belt 21 circularly rotates, its inward surface continuously rubs against the pressure applying auxiliary member 24*a*, in the nip N of the fixing device Q. Thus, in order to minimize the friction between the inward surface of the fixation belt 21 and the pressure applying auxiliary member 24*a*, the inward surface of the fixation belt 21 is coated with lubricant such as grease. However, as the lubricant coated on the inward surface of the fixation belt 21 is repeatedly subjected to heat and friction, it gradually deteriorates, allowing the friction between the fixation belt 21 and pressure applying auxiliary member 24*a* to increase. If the amount of frictional resistance between the fixation belt 21 and pressure applying auxiliary member 24*a* exceeds a certain value, the fixation belt 21 begins to slip and stop and/or continuously vibrates, which is likely to cause the fixing device Q to output a print which is lower in image quality. Thus, as the number of times the fixation belt 21 has been circularly moved exceeds a preset value, it is necessary for the fixation belt unit 20 to be replaced by a user.

(Method for Replacing Fixation Belt Unit)

Figure 15:
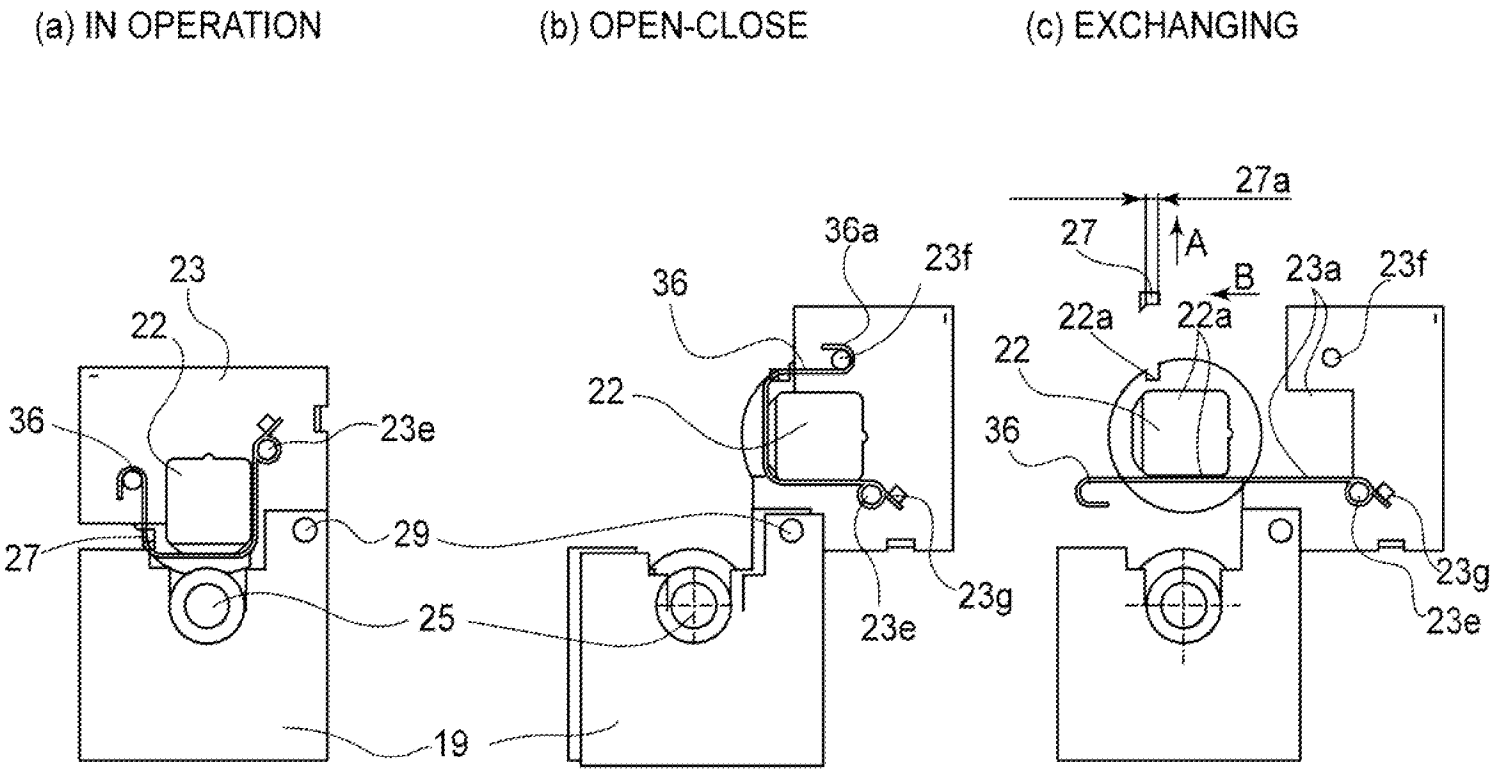
FIG. 15 is a drawing for showing how the fixation belt unit in the fixing device in the third embodiment is to be replaced, FIGS. 15(*a*), 15(*b*), and 15(*c*) showing the state of the fixing device when the fixing device is in operation, after its induction heating unit has been rotationally moved into the fixation belt unit replacement position, and when the fixation belt unit is being replaced.
Figure 16:
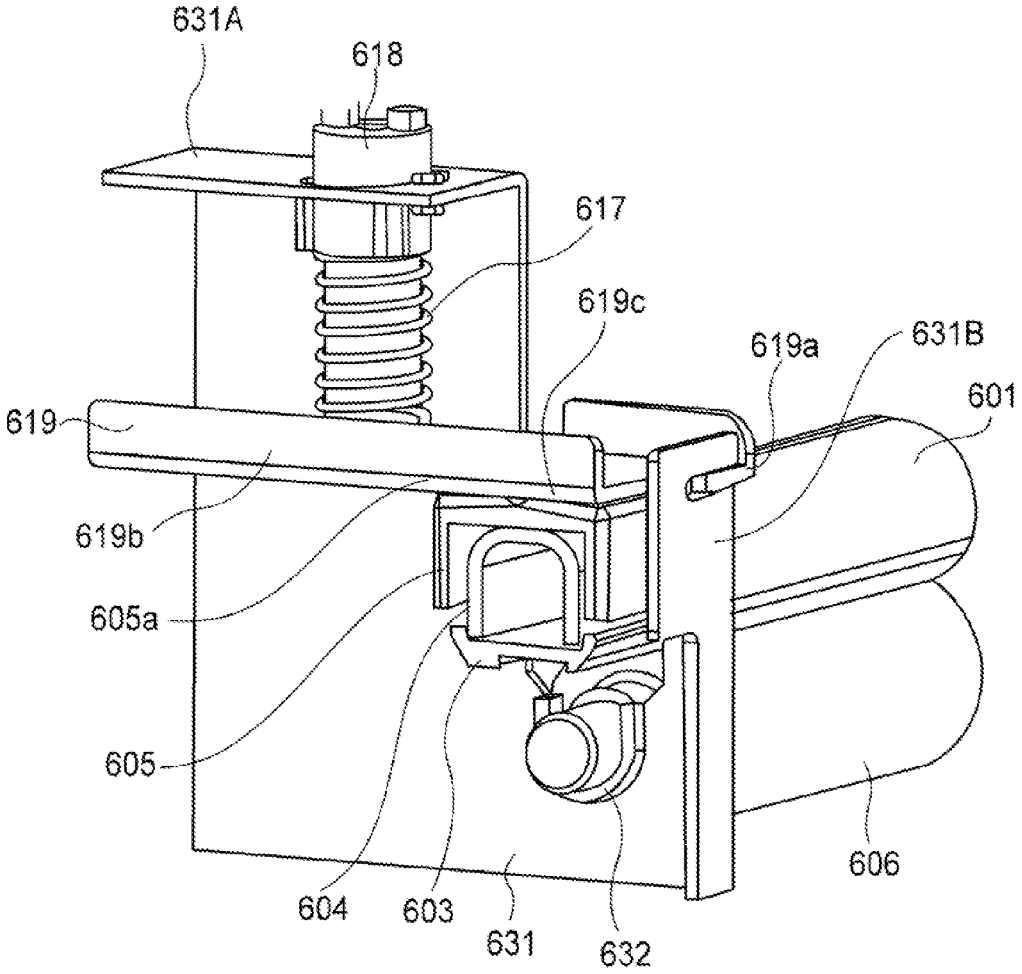
FIG. 16 is a perspective view of one of the lengthwise ends of a typical conventional fixing device.

Next, the method for replacing the fixation belt unit 20 (which is expendable) of the fixing device Q is described. FIG. 15 is a drawing for describing the method for replacing the fixation belt unit 20. The fixation belt unit 20 is structured so that the outward end of each of its pair of flanges 22 fits in the corresponding groove 23*a* with which the induction heating unit 23 is provided, and also, so that the induction heating unit 23 and fixation belt unit 20 are fastened to each other by the pair of wire springs 36, with the provision of the preset gap between the fixation belt 20 and induction heating unit 23. Further, the bottom side (lateral) plate 19 of the fixation device frame and the induction heating unit 23 are supported by the shaft 29. Thus, the induction heating unit 23 is rotatable upward or downward relative to the bottom side plate 19 about the shaft 29 in a manner to expose or cover the fixation belt unit 20.

The operational sequence for replacing the fixation belt unit 20 is as follows. Referring to FIG. 15(*b*), first, the induction heating unit 23 is to be rotated about the shaft 29 by a preset angle in a manner to be moved away from the bottom side plate 19. Incidentally, the fixing device Q is structured so that after the induction heating unit 23 is rotated by the preset angle away from the bottom side plate 19, it remains upright on its own. Then, the hook portion 36*a*, that is, one of the lengthwise end portions, of the wire spring 36 is to be disengaged from the projection 23*f* of the induction heating unit 23, in order to remove the force applied between the induction heating unit 23 and fixation belt unit 20 by the wiring spring 36. Here, in order to prevent that problem that the wire spring 36 falls and/or gets lost after being disengaged, the fixing device Q is structured so that after the disengagement of the wire spring 36, the wire spring 36 remains held by a pair of projections 23*e* and 23*g* with which the induction heating unit 23 is provided.

Next, the separation guide 27 is to be disengaged in the direction of the arrow mark A as shown in FIG. 15(*c*). Then, the fixation belt unit 20 is to be pulled out in the direction of the arrow mark B. Then, a brand-new fixation belt unit 20 is to be mounted. This is how a worn fixation belt unit 20, that is, a fixation belt unit 20, the fixation belt 21 of which has been circularly moved a greater number of times than a preset threshold value, is to be replaced with a brand-new one. Incidentally, the brand-new fixation belt unit 20 is placed in the fixing device after the separation guide 27 is attached to the brand-new fixation belt unit 20. After the placement of the brand-new fixation belt unit 20 in the fixation device, the fixation belt unit 20 is to be fastened to the induction heating unit 23 by the wire spring 36 to put the fixing device back into the state shown in FIG. 15(*a*).

In the third embodiment, the wire spring 36 for keeping the induction heating unit 23 and fixation belt unit 20 fastened to each other in such a manner that the preset amount of gap is maintained between the induction heating unit 23 and fixation belt unit 20 is made to double as the means for keeping the preset distance between the fixation belt 21 and separation guide 27. The fastening toggle in the second embodiment may be made to double as the means for keeping the preset distance between the fixation belt 21 and separation guide 27.

In the case of this embodiment, all that is necessary to replace the fixation belt unit 20 in the fixing device is to disengage and re-engage the wire springs 36. That is, the fixing device in this embodiment is simple in the operation for replacing the fixation belt unit 20 in the fixing device. Further, the fixing device is simpler in structure than any fixing device in accordance with the prior art, and yet, can ensure that the preset amount of gap is maintained between the fixation belt 21 and separation guide 27. Further, since the above describe method is used for keeping the induction heating unit 23 and fixation belt unit 20 fastened to each other, the combination of the weight of the induction heating member unit and the weight of the rotational heating member does not rest on the nip (pressure roller), after the pressure from the pressure applying means is removed. In other words, the present invention can provide an image heating apparatus which is superior to any image heating device in accordance with the prior art, in terms of the efficiency with which paper jam or the like can be dealt.

(Modification of Preferred Embodiments)

In the preceding embodiments of the present invention, the pressure applying members (33 and 34), fastening means (36, 37 and 38), and pressure catching portion (23*d*) are positioned at the ends of the image heating member (21) in terms of the direction perpendicular to the rotational direction of the image heating member. However, these preferred embodiments are not intended to limit the present invention in scope. For example, in place of the above described pressure applying member and/or fastening means, one of the known vacuum generating mechanisms may be positioned in the center portion of the image heating member, in terms of the direction perpendicular to the rotational direction of the image heating member. As is evident from the description of the preferred embodiment of the present invention, the present invention can provide an image heating apparatus which does not suffer from the problem that the combination of the weight of its induction heating member and the weight of its rotational heating member rests on the nip (pressure roller) after the removal of the pressure from the pressure applying member.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 278188/2010 filed Dec. 14, 2010, which is hereby incorporated by reference.

What is claimed is:

1. An image heating apparatus comprising:

a heating unit including a rotatable image heating member;

an induction heating unit configured to externally induction heat said image heating member;

a nip forming member press-contacting an outer surface of said image heating member to form a nip therewith;

a pressing member configured to press said heating unit to said nip forming member;

a press releasing member configured to release the pressure of said pressing member pressing said heating unit;

fastening means for fastening said heating unit and said induction heating unit together; and a force receiving portion, provided on said induction heating unit, configured to contact said pressing member to move said heating unit away from said nip forming member when said press releasing member releases said heating unit from the pressure of said pressing member, wherein said fastening means includes a spring member having one end fastened to a first position of said induction heating unit, extending so as to surround said heating unit, and further including another end fastened to a second position of said induction heating unit which is different from the first position.

2. An apparatus according to claim 1, wherein said pressing member, said fastening means and said force receiving portion are provided at a longitudinal end portion of said image heating member.

3. An image heating apparatus comprising:

a heating unit including a rotatable image heating member;

an induction heating unit configured to externally induction heat said image heating member;

a nip forming member press-contacting an outer surface of said image heating member to form a nip therewith;

a pressing member configured to press said heating unit to said nip forming member;

a press releasing member configured to release the pressure of said pressing member pressing said heating unit;

fastening means for fastening said heating unit and said induction heating unit together; and a force receiving portion, provided on said induction heating unit, configured to contact said pressing member to move said heating unit away from said nip forming member when said press releasing member releases said heating unit from the pressure of said pressing member, wherein said fastening means includes a lever holding said heating unit and connected with said induction heating unit, and a spring member having one end fastened to said induction heating unit and another end fastened to said lever.

4. An image heating apparatus comprising:

a heating unit including a rotatable image heating member;

an induction heating unit configured to externally induction heat said image heating member;

a nip forming member press-contacting an outer surface of said image heating member to form a nip therewith;

a pressing member configured to press said heating unit to said nip forming member;

a press releasing member configured to release the pressure of said pressing member pressing said heating unit;

fastening means for fastening said heating unit and said induction heating unit together; and a force receiving portion, provided on said induction heating unit, configured to contact said pressing member to move said heating unit away from said nip forming member when said press releasing member releases said heating unit from the pressure of said pressing member, wherein said image heating member includes a flexible heating belt configured to generate heat using a magnetic flux, a guiding member holding said heating belt at the opposite longitudinal end portions of said heating belt, and an auxiliary separating member inserted into an opening of said guiding member and confined by a spring member to assist separation of a recording material from said heating belt.

5. An apparatus according to claim 3, wherein said pressing member, said fastening means and said force receiving portion are provided at a longitudinal end portion of said image heating member.

6. An apparatus according to claim 4, wherein said pressing member, said fastening means and said force receiving portion are provided at a longitudinal end portion of said image heating member.

7. An image heating apparatus comprising:

a belt unit including an endless belt configured to heat a toner image on a sheet at a nip portion;

a coil unit including an coil provided outside said endless belt and configured to generate a magnetic flux for electromagnetic induction heating of said endless belt;

a supporting mechanism configured to support said coil unit;

a drive rotatable member configured to (i) drive said endless belt to rotate and (ii) form the nip portion cooperatively with said endless belt;

a pressing mechanism configured to press said belt unit toward said drive rotatable member to form the nip portion;

a releasing mechanism configured to release a pressing operation of said pressing mechanism relative to said belt unit; and an elastic member mounted on said coil unit so as to surroundingly hold a longitudinal end portion of said belt unit, said elastic member being configured to urge said belt unit toward said coil unit.

8. An apparatus according to claim 7, further comprising another elastic member mounted on said coil unit so as to surroundingly hold the other longitudinal end portion of said belt unit, said another elastic member being configured to urge said belt unit toward said coil unit.

9. An apparatus according to claim 7, further comprising a separating member provided at a position adjacent to an exterior surface of said endless belt and configured to assist separation of the sheet from said endless belt, wherein said elastic member urges said separating member toward said endless belt.

10. An apparatus according to claim 7, wherein said belt unit includes a guiding member provided in said endless belt and configured to guide rotation of said endless belt, and wherein said pressing mechanism presses a longitudinal end portion of said guiding member.

11. An apparatus according to claim 7, wherein said belt unit includes a guiding member provided in said endless belt and configured to guide rotation of said endless belt, and wherein said pressing mechanism presses said guiding member.

12. An apparatus according to claim 7, wherein said elastic member includes a spring member having a hooking portion, and wherein said coil unit includes a hooked portion configured to be engaged with said hooking portion of said spring member.

13. An apparatus according to claim 12, wherein said coil unit and said belt unit which are integrated by said elastic member are integrally retractable from said drive rotatable member, and wherein said belt unit is separable from said coil unit by disengagement of said hooking portion from said hooked portion when said coil unit and said belt unit are integrally retracted from said drive rotatable member.

14. An apparatus according to claim 13, said coil unit and said belt unit are integrally retractable from said drive rotatable member by an integral rotation operation of said coil unit and said belt unit.

15. An apparatus according to claim 7, wherein said drive rotatable member is a roller.

* * * * *